US006227812B1

(12) United States Patent
Kawaguchi et al.

(10) Patent No.: US 6,227,812 B1
(45) Date of Patent: May 8, 2001

(54) REFRIGERANT CIRCUIT AND COMPRESSOR

(75) Inventors: Masahiro Kawaguchi; Yoshihiro Makino; Masanori Sonobe; Koji Kawamura, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/041,583

(22) Filed: Mar. 12, 1998

(30) Foreign Application Priority Data

Mar. 13, 1997 (JP) ..... 9-059477

(51) Int. Cl.[7] ..... F04B 1/26

(52) U.S. Cl. ..... 417/222.2; 417/307; 417/440; 62/498

(58) Field of Search ..... 417/222.2, 307, 417/440, 441; 62/498, 296

(56) References Cited

U.S. PATENT DOCUMENTS

| | | | | |
|---|---|---|---|---|
| 5,112,198 | * | 5/1992 | Skinner | 417/269 |
| 5,362,210 | * | 11/1994 | Richardson, Jr. | 417/307 |
| 5,800,133 | * | 9/1998 | Ikeda et al. | 417/269 |
| 5,871,337 | * | 2/1999 | Fukanuma et al. | 417/222.2 |
| 6,036,457 | * | 3/2000 | Sekita et al. | 417/440 |

FOREIGN PATENT DOCUMENTS

| | | | | |
|---|---|---|---|---|
| 3142230A1 | | 9/1982 | (DE) . | |
| 4446302A1 | | 6/1995 | (DE) . | |
| 19517334A1 | | 11/1995 | (DE) . | |
| 19520757A1 | | 12/1995 | (DE) . | |
| 6-307721 | * | 11/1994 | (JP) | 62/498 |

OTHER PUBLICATIONS

Moran et al., Fundementals of Engineering Thrmodynamics, Wiley & Sons, New York, p. 439.*

* cited by examiner

*Primary Examiner*—Timothy S. Thorpe
*Assistant Examiner*—David J. Torrente
(74) *Attorney, Agent, or Firm*—Morgan & Finnegan, LLP

(57) ABSTRACT

A refrigerant circuit includes a compressor and an expansion valve. The expansion valve is connected to a discharge muffler of the compressor by a high pressure conduit. The expansion valve is also connected to a suction passage of the compressor by a low pressure conduit. The high pressure conduit includes a condenser and the low pressure conduit includes an evaporator. A check valve is located between the discharge muffler and the high pressure conduit to selectively connect and disconnect the high pressure conduit with the discharge muffler. A relief valve is attached to the discharge muffler upstream of the check valve. If the pressure in the compressor is abnormally high when the check valve closes, the relief valve releases the abnormally high pressure from the discharge muffler. Therefore, if the check valve fails to function, the relief valve prevents the pressure in the compressor from being abnormally high.

22 Claims, 8 Drawing Sheets

REFRIGERANT CIRCUIT AND COMPRESSOR

BACKGROUND OF THE INVENTION

The present invention relates to a refrigerant circuit and compressor that are incorporated in vehicle air conditioners A refrigerant circuit includes a compressor and an expansion valve. The outlet of the compressor is connected with the expansion valve by a high pressure conduit. The high pressure conduit includes a condenser. The inlet of the compressor is connected with the expansion valve by a low pressure conduit. The low pressure conduit includes an evaporator. The compressor compresses refrigerant gas and sends it to the condenser. The condenser receives high pressure, high temperature refrigerant gas from the compressor. The condenser then cools and liquefies the gas. The liquefied refrigerant is expanded by the expansion valve and is turned into mist. The refrigerant mist is drawn to the evaporator. In the evaporator, heat exchange takes place between the refrigerant mist and the air in a passenger compartment, and vaporizes the mist. At this time, the heat of vaporization cools the air. The cooled air is then used to cool the passenger compartment.

In prior art refrigerant circuits, heat exchangers such as condensers and evaporators have a small heat capacity and thus are easily heated. Contrarily, the compressor has relatively great heat capacity and is not easily heated. Therefore, when the compressor is stopped for an extended period, a change in the ambient temperature produces a temperature difference between the compressor and the heat exchangers. The temperature difference results in a pressure difference between the compressor and the heat exchangers. The pressure difference causes liquefied refrigerant in the heat exchangers to enter the compressor and to get mixed with lubricant oil stored in the compressor. When operation of the compressor is resumed, the liquefied refrigerant in the compressor foams up and quickly flows back to the refrigerant circuit. This also removes the oil mixed with the liquefied refrigerant from the compressor. Thus, lubrication of the compressor may become insufficient. In order to solve this problem, some prior art refrigerant circuits have a check valve in the vicinity of the compressor outlet for preventing liquefied refrigerant from entering the compressor.

However, a typical refrigerant circuit includes a relief valve to discharge abnormally high pressure from the refrigerant circuit. The relief valve is located in the high pressure conduit in the vicinity of the condenser. If such a circuit is provided with a check valve in the vicinity of the outlet of the compressor, a malfunction of the check valve can cause the pressure in the compressor to be abnormally high.

SUMMARY OF THE INVENTION

Accordingly, the objective of the present invention to provide a refrigerant circuit and compressor that prevent liquefied refrigerant from entering a compressor and prevents the pressure in the compressor from being abnormally high.

To achieve the above objective, the present invention provides a refrigerant circuit that includes a compressor and an expansion valve. A high pressure passage connects a discharge chamber in the compressor to the expansion valve to send high pressure refrigerant from the compressor to the expansion valve. A low pressure passage connects the expansion valve to a suction chamber in the compressor to send low pressure refrigerant from the expansion valve to the compressor. A valve device is located in the high pressure passage to selectively connect and disconnect the high pressure passage with the discharge chamber. A relief valve is located in the high pressure passage. The relief valve is located upstream of the valve device.

Also, the present invention provides a compressor that compresses refrigerant gas supplied from an external low pressure passage and discharges the compressed refrigerant gas from a discharge chamber to an external high pressure passage. The compressor includes an internal passage for connecting the discharge chamber to the high pressure passage. A valve device is located in the internal passage to selectively connect and disconnect the external high pressure passage with the discharge chamber. A relief valve is located between the discharge chamber and the valve device.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

FIG. 9(*b*) is a right side view diagram illustrating portions of the relief valve of FIG. 9(*a*).

DETAILED DESCRIPTION OF THE PREFERRED EMBODIMENTS

A refrigerant circuit according to a first embodiment of the present invention will now be described with reference to FIGS. 1 to 5. The refrigerant circuit includes a variable displacement compressor having single-headed pistons.

Figure 1:
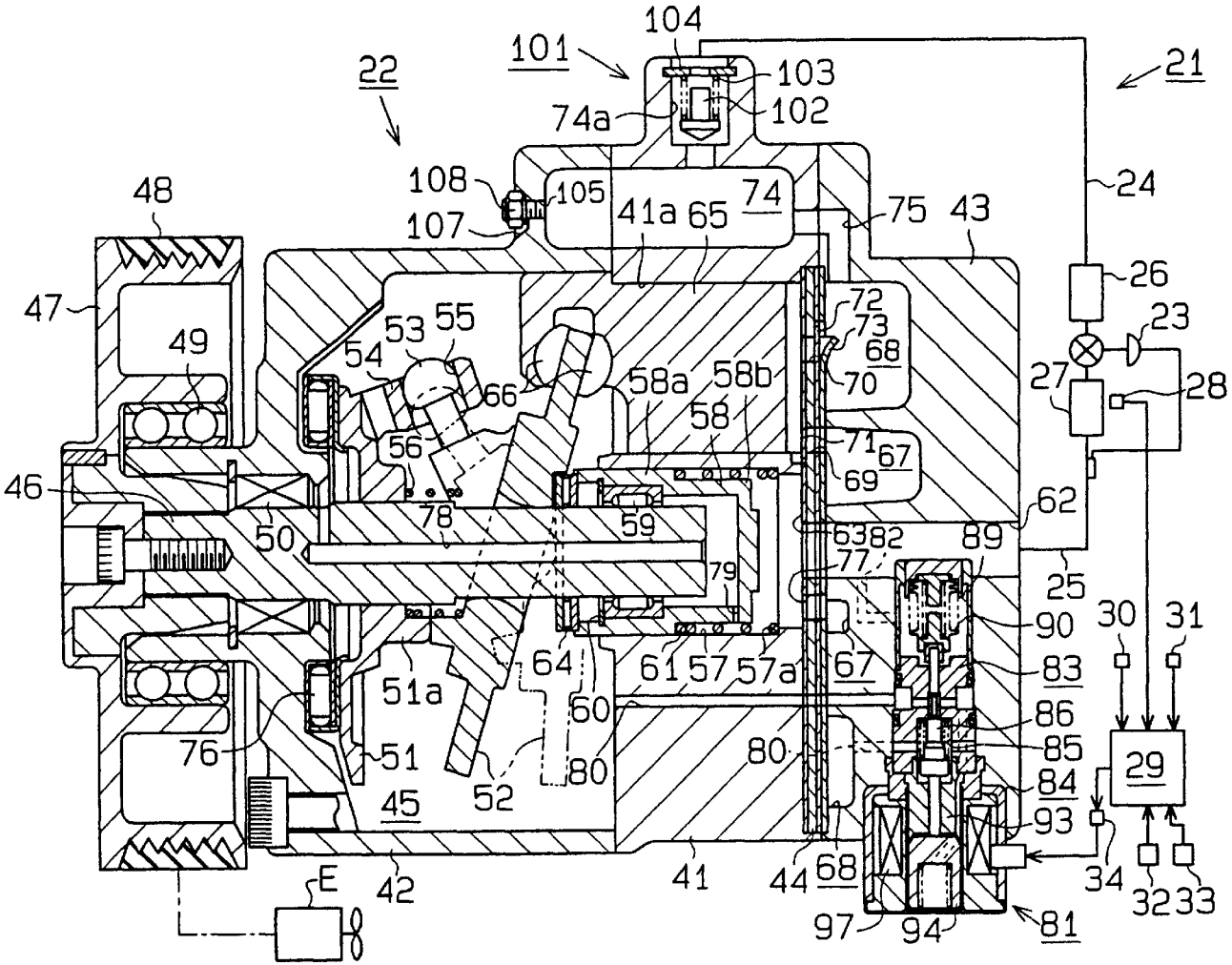
FIG. 1 is a block diagram showing a refrigerant circuit according to a first embodiment of the present invention including a cross-sectional view of a compressor in the circuit.

As shown in FIG. 1, a refrigerant circuit 21 includes a compressor 22 and an expansion valve 23. The expansion valve 23 is connected to an outlet 74*a* of the compressor by a high pressure conduit 24. The expansion valve 23 is also connected to a suction passage 62 of the compressor 62 by a low pressure conduit 25. The high pressure conduit 24 includes a condenser 26 and the low pressure conduit 25 includes an evaporator 27.

The expansion valve 23 is a temperature controlled automatic expansion valve that controls the flow rate of refrigerant in accordance with the temperature of refrigerant gas at the outlet of the evaporator 27. A temperature sensor 28 is located in the vicinity of the evaporator 27. The temperature sensor 28 detects the temperature of the evaporator 27 and issues signals relating to the detected temperature to a computer 29. The computer 29 is also connected to a temperature adjuster 30, a compartment temperature sensor 31, an air conditioner starting switch 30 and an engine speed sensor 33. A passenger sets a desirable compartment temperature, or a target temperature, by the temperature adjuster 30. The engine speed sensor 33 detects the speed of a vehicle engine E, or an external drive source, which drives the compressor 22.

The computer 29 receives various information including, for example, a target temperature set by the temperature adjuster 30, the temperature detected by the temperature sensor 28, the passenger compartment temperature detected by the temperature sensor 33, the engine speed detected by the engine speed sensor 33 and an ON/OFF signal from the starting switch 32. Based on this information, the computer 29 computes the value of a current supplied to a displacement control valve 81 in the compressor 22 and transmits the computed current value to a driver 84. The driver 34 sends a current having the value transmitted from the computer 29 to a coil 97 in the valve 81. The coil 97 will be described later. The information for determining the current value for the valve 81 may include information other than that listed above, for example, the information may include the temperature outside of the vehicle.

The construction of the compressor 22 will now be described. As shown in FIG. 1, the compressor 22 includes cylinder block 41. A front housing 42 is secured to the front end face of the cylinder block 41. A rear housing 43 is secured to the rear end face of the cylinder block 11 with a valve plate 44. The inner walls of the front housing 42 and the front end face of the cylinder block 11 define a crank chamber 45.

A drive shaft 46 is rotatably supported in the front housing 42 and the cylinder block 41. The front end of the drive shaft 46 protrudes from the crank chamber 45 and is secured to a pulley 47. The pulley 47 is directly coupled to the engine E by a belt 48. The compressor 22 of this embodiment is referred to as a clutchless type variable displacement compressor since it is not clutched on and off. The pulley 47 is supported by the front housing 42 with an angular bearing 49. The angular bearing 49 transfers thrust and radial loads that act on the pulley 47 to the housing 42.

A lip seal 50 is located between the drive shaft 46 and the front housing 42. The lip seal 50 prevents refrigerant gas in the crank chamber 45 from leaking outside.

A disk-like swash plate 52 is supported by the drive shaft 46 in the crank chamber 45 to slide along and tilt with respect to the axis of the shaft 46. A pair of guiding pins 53 are fixed to the swash plate 52. Each guiding pin 53 has a guide ball at its distal end. A rotor 51 is fixed to the drive shaft 46 in the crank chamber 45 to rotate integrally with the drive shaft 46. The rotor 51 has a support arm 54 protruding toward the swash plate 52. A pair of guide holes 55 are formed in the support arm 54. Each guide pin 53 is slidably fitted into the corresponding guide hole 55.

The cooperation of the arm 54 and the guide pins 53 permits the swash plate 52 to rotate together with the drive shaft 46. The cooperation also guides the tilting of the swash plate 52 and the movement of the swash plate 52 along the axis of the drive shaft 46. As the swash plate 52 slides rearward toward the cylinder block 41, the inclination of the swash plate 52 decreases.

The rotor 51 has a projection 51*a* on its rear end face. Abutment of the swash plate 52 against the projection 51*a* limits the maximum inclination of the swash plate 52. A coil spring 56 is located between the rotor 51 and the swash plate 52. The spring 56 urges the swash plate 52 in a direction to decrease the inclination of the swash plate 52.

The cylinder block 41 has a shutter chamber 57 at its center portion. The shutter chamber 57 extends along the axis of the drive shaft 46 and accommodates a hollow cylindrical shutter 58 having a closed end. The shutter 58 slides along the axis of the drive shaft 46 and has a large diameter portion 58*a* and a small diameter portion 58*b*. A coil spring 61 is located between a step 57*a* formed in the shutter chamber 57 and a step, which is formed between the large diameter portion 58*a* and the small diameter portion 58*b*. The coil spring 61 urges the shutter 58 toward the swash plate 52. The urging force of the spring 61 is weaker than the urging force of the spring 56.

The rear end of the drive shaft 46 is inserted in the shutter 58. The radial bearing 59 is fixed to the inner wall of the large diameter portion 58*a* of the shutter 58 by a snap ring 60. Therefore, the radial bearing 59 moves with the shutter 58 along the axis of the drive shaft 46. The rear end of the drive shaft 46 is supported by the inner wall of the shutter chamber 57 with the radial bearing 59 and the shutter 58 in between.

The suction passage 62 is defined at the center portion of the rear housing 43 and the valve plate 44. The passage 62 extends along the axis of the drive shaft 46. The outer end of the passage 62 is connected to the low pressure conduit 25 of the refrigerant circuit 21. The inner end of the passage 62 communicates with the shutter chamber 57. The passage 62 constitutes a part of the low pressure conduit 25. A positioning surface 63 is formed on the valve plate 44 about the inner opening of the suction passage 62. The rear end of the shutter 58 abuts against the positioning surface 63. Abutment of the shutter 58 against the positioning surface 63 prevents the shutter 58 from further moving rearward away from the rotor 51. The abutment also disconnects the suction passage 62 from the shutter chamber 57.

A thrust bearing 64 is supported on the drive shaft 46 and is located between the swash plate 52 and the shutter 58. The thrust bearing 64 slides along the axis of the drive shaft 46. The force of the spring 61 constantly retains the thrust bearing 64 between the swash plate 52 and the shutter 58. The thrust bearing 64 prevents the rotation of the swash plate 52 from being transmitted to the shutter 58.

The cylinder block 41 includes cylinder bores 41*a* extending therethrough. The cylinder bores 41*a* are located about the axis of the drive shaft 46. Each cylinder bore 41*a* accommodates a single-headed piston 65. Each piston 65 is operably coupled to the swash plate 52 by a pair of shoes 66. Rotation of the swash plate 52 is transmitted to each piston 65 through the shoes 66 and is converted to linear reciprocation of each piston 65 in the associated cylinder bore 41*a*.

The rear housing 43 includes an annular suction chamber 67 and an annular discharge chamber 68. The suction chamber 67 is defined about the suction passage 62 and the discharge chamber 68 is defined about the suction chamber 67. The valve plate 44 has suction ports 69 and discharge ports 70. Each suction port 69 and each discharge port 70 correspond to one of the cylinder bores 41*a*. The valve plate 44 has suction valve flaps 71 and discharge valve flaps 72. Each suction valve flap 71 corresponds to one of the suction ports 69 and each discharge valve flap 72 corresponds to one of the discharge ports 70. The valve plate 44 has retainers 73. Each retainer 73 corresponds to one of the discharge valve flaps 72.

As each piston 65 moves from the top dead center to the bottom dead center in the associated cylinder bore 41*a*, refrigerant gas in the suction chamber 67 enters the cylinder bore 41*a* through the associated suction port 69 while causing the associated suction valve flap 71 to flex to an open position. As each piston 65 moves from the bottom dead center to the top dead center in the associated cylinder bore 41*a*, refrigerant gas is compressed in the cylinder bore 41*a* and is discharged to the discharge chamber 68 through the associated discharge port 70 while causing the associated discharge valve flap 72 to flex to an open position. The opening amount of each discharge valve flap 72 is defined by the associated retainer 73.

A thrust bearing 76 is located between the front housing 42 and the rotor 51. The thrust bearing 76 carries the reactive force of gas compression acting on the rotor 51 through the pistons 65 and the swash plate 52.

A discharge muffler 74 is provided at the upper peripheral portion of the cylinder block 41 and front housing 42. The muffler 74 is connected to the discharge chamber 68 by a passage 75 for suppressing pulsation of refrigerant gas discharged from the discharge chamber 68. The muffler 74 is also connected to the high pressure conduit 24. of the refrigerant circuit 21 by a discharge passage 74*a*. The muffler 74 constitutes a part of the high pressure conduit 24.

The suction chamber 67 is connected with the shutter chamber 57 by a hole 77. When contacting the positioning surface 63, the shutter 58 closes the suction passage 62 thereby disconnecting the hole 77 from the suction passage 62. The shutter 58 selectively connects the low pressure conduit 25 of the refrigerant circuit 21 with the compressor 22 and disconnects the conduit 25 from the compressor 22.

As shown in FIG. 1, the drive shaft 46 has an axial passage 78. The passage 78 has an inlet, which opens to the crank chamber 45 in the vicinity of the lip seal 50, and an outlet, which opens to the interior of the shutter 58. The interior of the shutter 58 is connected with the shutter chamber 57 by a pressure release hole 79, which is formed in the shutter wall near the rear end of the shutter 58.

The discharge chamber 68 is connected with the crank chamber 45 by a supply passage 80. The supply passage 80 is regulated by a displacement control valve 81, which is accommodated in the rear housing 43. The control valve 81 is connected with the suction passage 62 by a pressure introduction passage 82. The passage 82 introduces suction pressure into the control valve 81.

Figure 2:
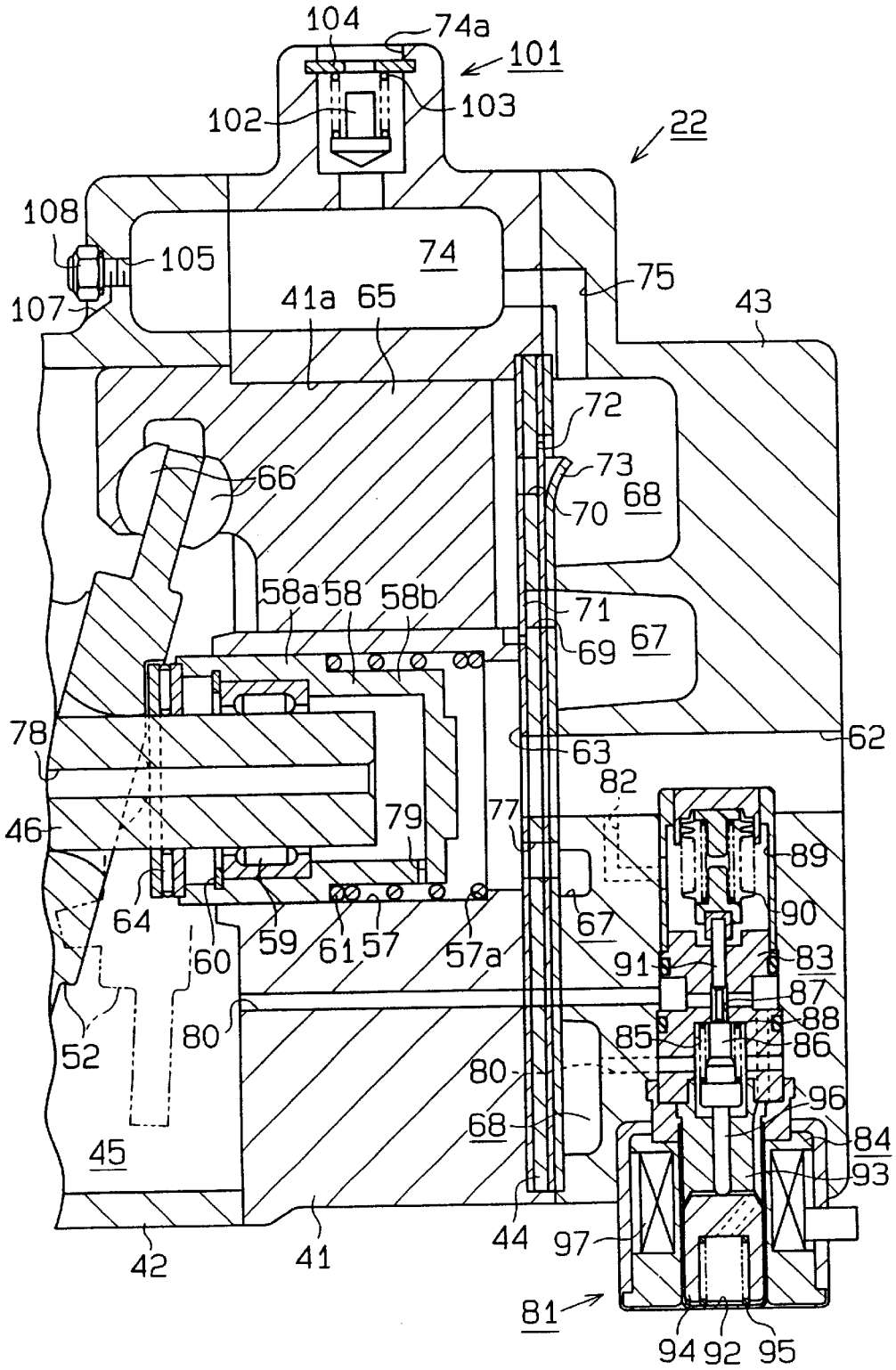
FIG. 2 is an enlarged partial cross-sectional view illustrating the compressor of FIG. 1.

As shown in FIGS. 1 and 2, the control valve 81 includes a housing 83 and the solenoid 84. The housing 83 and the solenoid 84 are secured to each other and define a valve chamber 85 in between. The valve chamber 85 accommodates a valve body 86 and is connected with the discharge chamber 68 by the upstream portion of the supply passage 80. The housing 83 also has a valve hole 87 extending along its axis. The valve hole 87 is also connected with the crank chamber 45 by the downstream portion of the supply passage 80. That is, the valve chamber 85 and the valve hole 87 constitute a part of the supply passage 80. A spring 88 extends between the valve body 86 and a wall of the valve chamber 85. The spring 88 urges the valve body 86 in a direction opening the valve hole 87.

A pressure sensing chamber 89 is defined in the upper portion of the control valve 81 on top of the housing 83. The sensing chamber 89 is connected with the suction passage 62 by the pressure introduction passage 82 and accommodates a bellows 90. The bellows 90 is coupled to the valve body 86 by a rod 91. The rod 91 has a small diameter portion, which extends within the valve hole 87. The clearance between the small diameter portion and the valve hole 87 permits the flow of refrigerant gas.

The solenoid 84 includes a plunger chamber 92 and a fixed steel core 93 press fitted in the upper opening of the plunger chamber 92. The plunger chamber 92 accommodates a cylindrical steel plunger 94. The plunger 94 slides with respect to the chamber 92. A spring 95 extends between the plunger 94 and the bottom of the plunger chamber 92. The urging force of the spring 95 is smaller than that of the spring 88. The plunger 94 is coupled to the valve body 86 by a solenoid rod 96.

The solenoid 84 has a cylindrical coil 97, which is wound about the fixed core 93 and the plunger 94. The driver 34 provides the coil 97 with electric current based on commands from the computer 29. That is, the magnitude of the current supplied to the coil 97 is determined by the computer 29.

As shown in FIGS. 1, 2, 4 and 5, the discharge muffler 74 is connected with the high pressure conduit 24 by the discharge passage 74*a*. The discharge passage 74*a* accommodates a check valve 101 for opening and closing the passage 74*a*. The check valve 101 includes a valve body 102, a spring 103 and a spring seat 104. The check valve 101 prevents liquefied refrigerant from flowing from the high pressure conduit 24 into the discharge muffler 74 and allows refrigerant gas to flow from the muffler 74 to the high pressure conduit 24.

Figure 3:
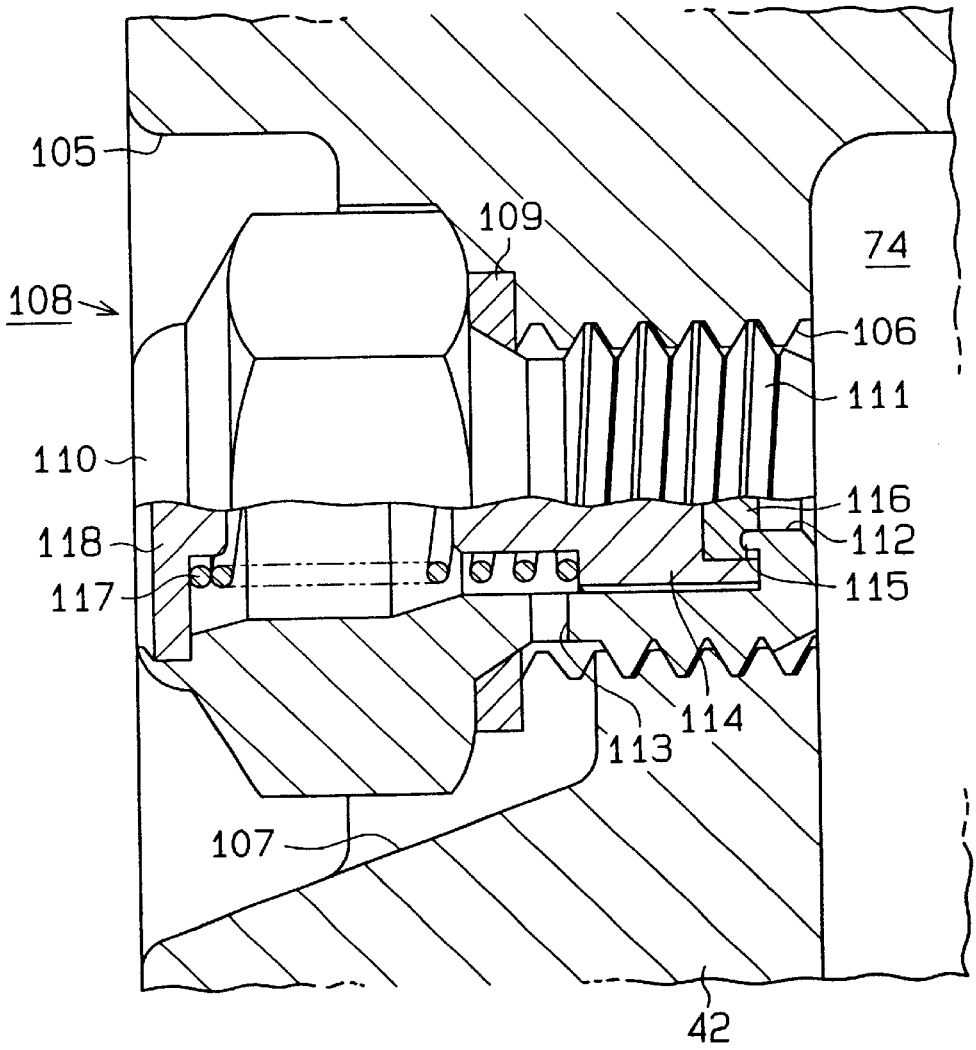
FIG. 3 is an enlarged partial cross-sectional view illustrating the relief valve of FIG. 1.

As shown in FIGS. 1 and 3, a bore 105 is formed in a side wall of the muffler 74. The bore 105 extends parallel to the axis of the front housing 42. The inner end of the bore 105 is threaded. A slant relief groove 107 is formed in the outer portion of the bore 105.

A relief valve 108 is screwed to the bore 105 with a seal 109 in between. The relief valve 108 includes a hollow bolt-like housing 110. The housing 110 includes a threaded portion 111, which is engaged with the threaded portion 106 of the bore 105. A pressure receiving hole 112 is formed in the inner end of the housing 110 to communicate with the interior of the discharge muffler 74. A pressure relief hole 113 is formed in the middle wall of the housing 110 to communicate with the groove 107.

A valve seat 115 is formed in the inner opening of the pressure receiving hole 112. The valve seat 115 faces a valve body 114, which is movably accommodated in the housing 110. The valve body 114 has a contact portion 116 press fitted thereto. The contact portion 116 is made of an elastic material such as rubber and abuts against the valve seat 115. A spring seat 118 is fixed to the outer end of the housing 110. A spring 117 extends between the spring seat 118 and the valve body 114 for urging the valve body 114 toward the valve seat 115. In the normal state, the contact portion 116 of the valve body 114 is pressed against the valve seat 115 and disconnects the pressure relief hole 113 from the pressure receiving hole 112.

The operation of the refrigerant circuit 21 will now be described.

When the drive shaft 46 of the compressor 22 is rotated by the engine E, high pressure and high temperature refrigerant gas is discharged from the cylinder bores 41*a* to the discharge chamber 68. If the swash plate 52 is at the maximum inclination position as illustrated in FIGS. 1 and 2, the compressor 22 operates at a large displacement. In this state, the discharge pressure in the discharge muffler 74 is high. The high discharge pressure acts on the check valve 101 in the discharge passage 74*a*. The difference between the pressure in the muffler 74 and the pressure in the high pressure conduit 24 pushes the valve body 102 against the force of the spring 103 thereby opening the discharge passage 74*a*. This allows the highly pressurized refrigerant gas to flow from the muffler 74 to the condenser 26 through the discharge passage 74*a* and the high pressure conduit 24.

The condenser 26 cools the high temperature and high pressure refrigerant gas thereby turning the gas into low temperature, high pressure refrigerant liquid. The refrigerant liquid is drawn to the expansion valve 23. The expansion valve 23 expands the refrigerant liquid thereby atomizing the liquid into low temperature, low pressure refrigerant mist. The refrigerant mist is led to the evaporator 27. At the evaporator 27, the mist is warmed and vaporized by the air in the passenger compartment. At this time, the heat of vaporization of the mist cools the air. The low temperature, low pressure refrigerant gas in the evaporator 27 then flows back to the compressor 22 through the low pressure conduit 25.

When the air conditioner starting switch 32 is on, if the temperature detected by the compartment temperature sensor 31 is higher than a target temperature set by the temperature adjuster 30, the computer 29 commands the driver 34 to excite the solenoid 84. Accordingly, the driver 34 actuates the solenoid 84 with electric current having a certain magnitude. This produces a magnetic attractive force between the fixed core 93 and the plunger 94 in accordance with the current magnitude. The attractive force is transmitted to the valve body 86 by the second rod 96 and thus urges the valve body 86 against the force of the spring 88 in a direction closing the valve hole 87. On the other hand, the length of the bellows 90 varies in accordance with the suction pressure in the suction passage 62 that is introduced to the pressure sensing chamber 89 via the pressure introduction passage 82. The changes in the length of the bellows 90 are transmitted to the valve body 86 by the rod 91.

The opening area between the valve body 86 and the valve hole 87 is determined by the equilibrium of forces acting on the valve body 86. Specifically, the opening area is determined by the equilibrium position of the body 86, which is affected by the force of the solenoid 84, the force of the bellows 90 and the force of the spring 88.

Suppose the cooling load is great, the suction pressure is high and the temperature in the vehicle compartment detected by the sensor 31 is higher than a target temperature set by the temperature adjuster 30. The computer 29 commands the driver 34 to increase the magnitude of the current sent to the coil 97 as the difference between the compartment temperature and the target temperature increases. This increases the attractive force between the fixed core 93 and the plunger 94, thereby increasing the resultant force that causes the valve body 86 to close the valve hole 87. Accordingly, the pressure required for moving the valve body 86 in a direction closing the valve hole 87 is lowered. In this state, the valve body 86 changes the opening of the valve hole 87 in accordance with relatively low suction pressure. In other words, as the magnitude of the current to the control valve 81 is increased, the valve 81 functions to maintain the pressure (the target suction pressure) at a lower level.

A smaller opening area between the valve body 86 and the valve hole 87 represents a decreased amount of refrigerant gas flow from the discharge chamber 68 to the crank chamber 45 via the supply passage 80. The refrigerant gas in the crank chamber 45 flows into the suction chamber 67 via the axial passage 78 and the pressure release hole 79. This lowers the pressure in the crank chamber 45. Further, when the cooling load is great, the suction pressure is high. Accordingly, the pressure in each cylinder bore 41*a* is high. Therefore, the difference between the pressure in the crank chamber 45 and the pressure in the cylinder bores 41*a* is small. This increases the inclination of the swash plate 52, thereby causing the compressor 22 to operate at a large displacement.

As the displacement of the compressor 22 increases, the amount of refrigerant gas discharged from the compressor 22 to the high pressure conduit 24 of the refrigerant circuit 21 is increased. This increases the amount of refrigerant in the circuit 21. In other words, the amount of gasfied refrigerant condensed by the condenser 26 and the amount of liquefied refrigerant vaporized by the evaporator 27 are increased. The circuit 21 thus operates at a higher level of refrigeration.

When the valve body 86 completely closes the valve hole 87, the supply passage 80 is closed. This stops the supply of the highly pressurized refrigerant gas in the discharge chamber 68 to the crank chamber 45. Therefore, the pressure in the crank chamber 45 becomes substantially equal to the low pressure in the suction chamber 67. This maximizes the inclination of the swash plate 52 as shown in FIGS. 1 and 2, thereby causing the compressor 22 to operate at the maximum displacement. The abutment of the swash plate 52 against the projection 51*a* of the rotor 51 limits the maximum inclination of the swash plate 52.

Suppose the cooling load is small, the suction pressure is low and the difference between the compartment temperature detected by the sensor 31 and a target temperature set by the temperature adjuster 30 is small. The computer 29 commands the driver 34 to decrease the magnitude of the current sent to the coil 97 as the difference between the compartment temperature. and the target temperature becomes smaller. This decreases the attractive force between the fixed core 93 and the plunger 94, thereby decreasing the resultant force that moves the valve body 86 in a direction closing the valve hole 87. This raises the suction pressure required for moving the valve body 86 in a direction to close the valve hole 87. In this state, the valve body 86 changes the opening of the valve hole 87 in accordance with relatively high suction pressure. In other words, as the magnitude of the current to the control valve 81 is decreased, the valve 81 functions to maintain the suction pressure (target suction pressure) at a higher level.

A larger opening area between the valve body 86 and the valve hole 87 increases the amount of refrigerant gas flow from the discharge chamber 68 to the crank chamber 45. This increases the pressure in the crank chamber 45. Further, when the cooling load is small, the suction pressure is low and the pressure in the cylinder bores 41*a* is low. Therefore, the difference between the pressure in the crank chamber 45 and the pressure in the cylinder bores 41*a* is great. This decreases the inclination of the swash plate 52. The compressor 22 thus operates at a small displacement.

As the displacement of the compressor 22 decreases, the amount of refrigerant gas discharged from the compressor 22 to the high pressure conduit 24 of the refrigerant circuit 21 is decreased. This decreases the amount of refrigerant in the circuit 21. In other words, the amount of gasfied refrigerant condensed by the condenser 26 and the amount of liquefied refrigerant vaporized by the evaporator 27 are decreased. The circuit 21 thus operates at a lower level of refrigeration.

Figure 4:
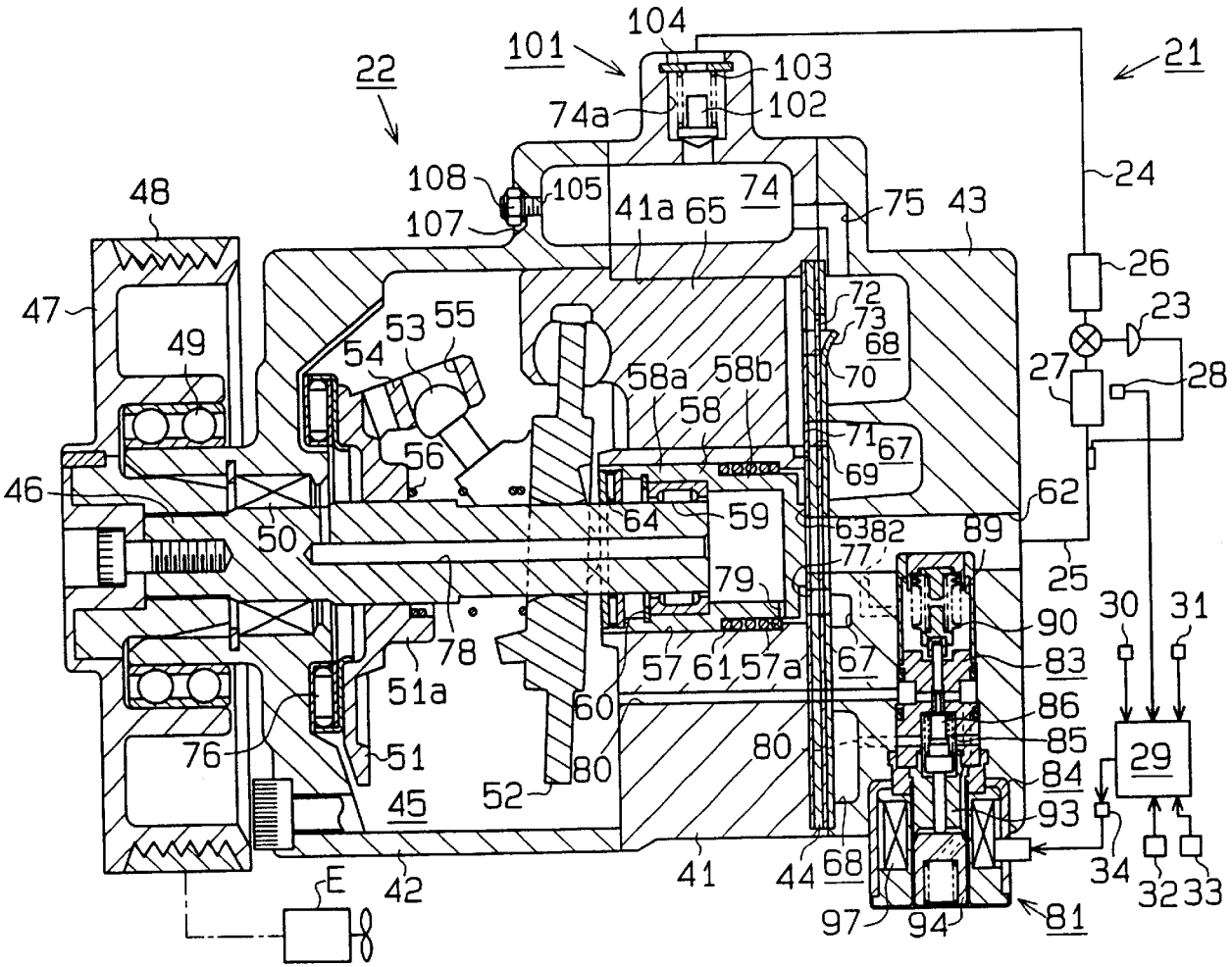
FIG. 4 is a view like FIG. 1 illustrating the compressor of FIG. 1 when the inclination of the swash plate is minimum.
Figure 5:
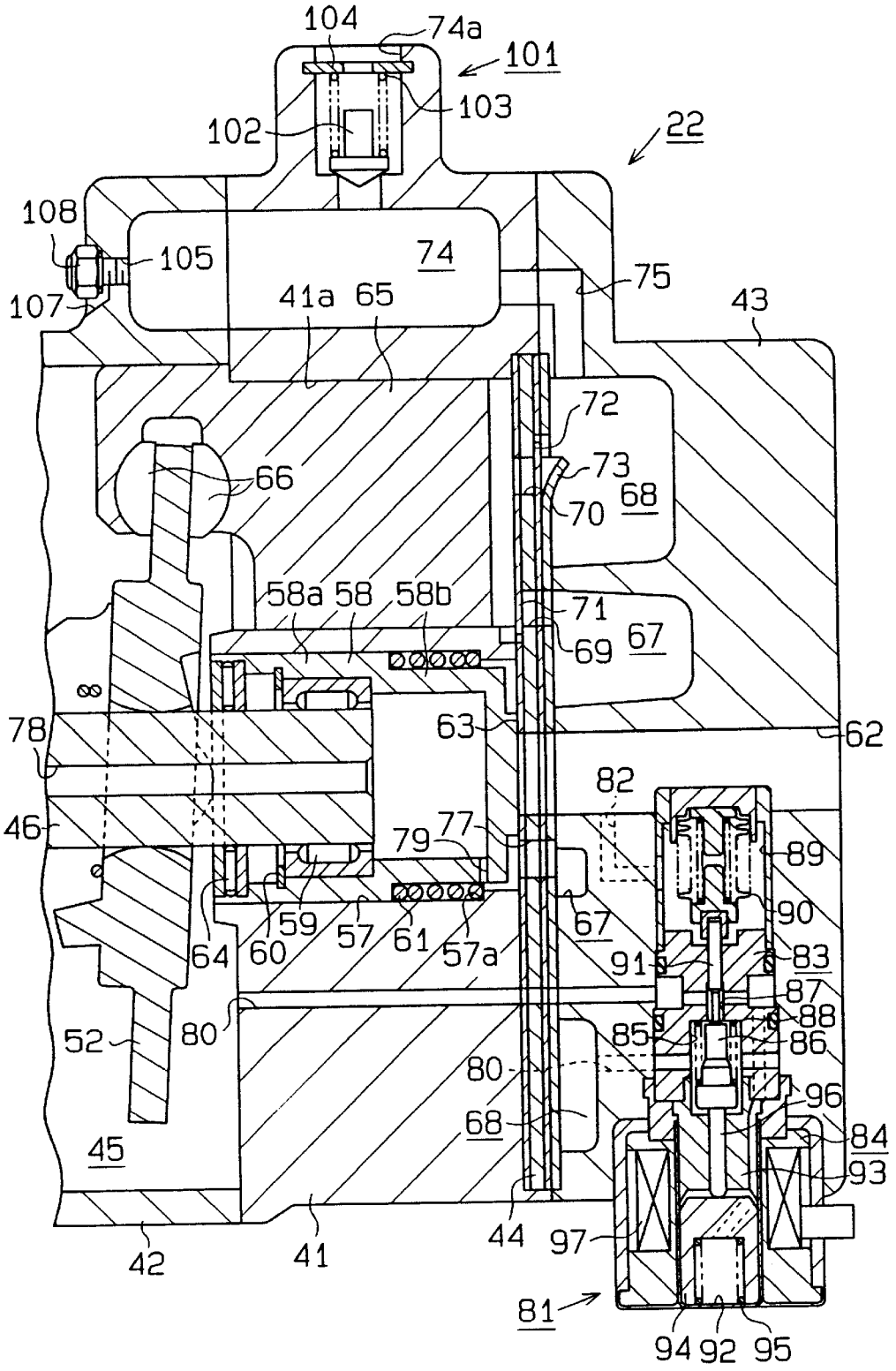
FIG. 5 is an enlarged partial cross-sectional view of FIG. 4.

As the cooling load is smaller than a cooling capacity of the compressor, the temperature of the evaporator 27 drops to a frost forming temperature. When the temperature sensor 28 detects a temperature that is equal to or lower than the frost forming temperature, the computer 29 commands the driver 34 to de-excite the solenoid 84. The driver 34 stops sending current to the coil 97, accordingly. This stops the magnetic attractive force between the fixed core 93 and the plunger 94. The valve body 86 is then moved by the force of the spring 88 against the force of the spring 95 transmitted by the plunger 94 and the solenoid rod 96 as illustrated in FIGS. 4 and 5. In other words, the valve body 86 is moved in a direction to open the valve hole 87. This maximizes the opening area between the valve body 86 and the valve hole 87. Accordingly, gas flow from the discharge chamber 68 to the crank chamber 45 is increased. This further raises the pressure in the crank chamber 45, thereby minimizing the inclination of the swash plate 52. The compressor 22 thus operates at the minimum displacement.

When the switch 32 is turned off, the computer 29 commands the driver 34 to de-excite the solenoid 84. Accordingly, the inclination of the swash plate 52 is minimized.

As described above, when the magnitude of the current to the coil 97 is increased, the valve body 86 functions such that the opening of the valve hole 87 is closed by a lower suction pressure. When the magnitude of the current to the coil 97 is decreased, on the other hand, the valve body 86 functions such that the opening of the valve hole 87 is closed by a higher suction pressure. The compressor 22 changes the inclination of the swash plate 52 to adjust its displacement thereby maintaining the suction pressure at a target value. The functions of the control valve 81 include changing the target value of the suction pressure in accordance with the magnitude of the supplied current. Another function of the valve 81 is maximizing the opening area of the valve hole 87 thereby allowing the compressor 22 to operate at the minimum displacement at any given suction pressure. The compressor 22, which is equipped with the control valve 81 having such functions, varies the refrigeration level of the refrigerant circuit 21.

When the inclination of the swash plate 52 is minimum as illustrated in FIG. 4, the shutter 58 abuts against the positioning surface 63. The abutment limits the minimum inclination of the swash plate 25 and disconnects the suction passage 62 from the suction chamber 67. Therefore, refrigerant gas does not flow into the compressor 22 from the low pressure conduit 25.

The minimum inclination of the swash plate 52 is slightly larger than zero degrees. Zero degrees refers to the angle of the swash plate's inclination when it is normal to the axis of the drive shaft 46. Therefore, even if the inclination of the swash plate 52 is minimum, refrigerant gas in the cylinder bores 41*a* is discharged to the discharge chamber 68 and the compressor 22 operates at the minimum displacement. The refrigerant gas discharged to the discharge chamber 68 from the cylinder bores 41*a* enters the crank chamber 45 through the supply passage 80. The refrigerant gas in the crank chamber 45 is drawn back into the cylinder bores 41*a* through the axial passage 78, the pressure release hole 79 and the suction chamber 67. That is, when the inclination of the swash plate 52 is minimum, refrigerant gas circulates within the compressor 22 traveling through the discharge chamber 68, the supply passage 80, the crank chamber 45, the axial passage 78, the pressure release hole 79, the suction chamber 67 and the cylinder bores 41*a*. This circulation of refrigerant gas allows lubricant oil contained in the gas to lubricate the moving parts of the compressor 22.

When the inclination of the swash plate 52 is minimum, the displacement of the compressor 22 and the discharge pressure in the discharge chamber 68 are also minimum. Therefore, the pressure in the discharge muffler 74 becomes low. That is, the pressure acting on the valve body 102 of the check valve 101 is decreased. This causes the valve body 102 to be moved by the force of the spring 103 away from the spring seat 104. The valve body 102 eventually closes the discharge passage 74*a* thereby disconnecting the high pressure conduit 24 from the compressor 22.

In this manner, when the swash plate 52 is at the minimum inclination position, refrigerant gas is not discharged to the high pressure conduit 24 from the compressor 22. Also, refrigerant gas is not drawn into the compressor 22 from the low pressure conduit 25. Therefore, refrigerant gas is only circulated within the compressor 22. That is, the circulation of refrigerant in the refrigerant circuit 21 is stopped. Therefore, refrigerant mist is not supplied to the evaporator 27. The circuit 21 thus performs no refrigeration.

If the switch 32 is on and the inclination of the swash plate 52 is minimum, an increase in the compartment temperature increases the cooling load. In this case, the temperature detected by the compartment temperature sensor 31 is higher than a target temperature set by the compartment temperature adjuster 30. The computer 29 commands the driver 34 to excite the solenoid 84 based on the detected temperature increase. The solenoid 84 then decreases the opening of the supply passage 80 thereby decreasing the amount of refrigerant gas supplied to the crank chamber 45 from the discharge chamber 68. This gradually lowers the pressure in the crank chamber 45. The inclination of the swash plate 52 is increased accordingly.

The increase of the inclination of the swash plate 52 causes the shutter 58 to be gradually moved by the force of the spring 61 away from the positioning surface 63. This gradually enlarges the cross-sectional area of the passage between the suction passage 62 and the suction chamber 67. Accordingly, the amount of refrigerant gas flow from the low pressure conduit 25 into the suction chamber 67 gradually increases. Therefore, the amount of refrigerant gas that enters the cylinder bores 41*a* from the suction chamber 67 gradually increases. The displacement of the compressor 22 and the discharge pressure are gradually increased, accordingly. This gradually increases the pressure in the muffler 74. In this state, the check valve 101 opens the discharge passage 74*a* as described above thereby allowing highly pressurized refrigerant gas in the compressor 22 to flow into the high pressure conduit 24. The circuit 21 thus resumes the refrigerant of the passenger compartment.

If the engine E is stopped, the compressor 22 is also stopped, that is, the rotation of the swash plate 52 is stopped, and the supply of current to the coil 97 in the control valve 81 is stopped. Therefore, the solenoid 84 is de-excited and opens the supply passage 80. Accordingly, the inclination of the swash plate 52 is minimized.

The discharge muffler 74 has the relief valve 108, which includes the valve body 114 and the valve seat 115. Normally, the valve body 114 abuts against the valve seat 115 thereby disconnecting the pressure receiving hole 112 from the relief hole 113. If the pressure in the muffler 74 excessively increases and exceeds a predetermined level during the operation of the compressor 22, the valve body 114 is moved against the force of the spring 117 away from the valve seat 115 thereby connecting the pressure receiving hole 112 with the relief hole 113. The excessive pressure in the muffler 74 is released to the outside of the compressor 22 via the pressure receiving hole 112, the relief hole 113 and the relief groove 107.

This embodiment has the following advantages.

The discharge chamber 68 of the compressor is connected with the expansion valve 23 by the high pressure conduit 24, which includes a check valve 101. The check valve 101 opens and closes the conduit 24 to the compressor 22. The conduit 24 also includes a relief valve 108 at an upstream position with respect to the check valve 101. Specifically, the muffler 74 is connected with the high pressure conduit 24 by the discharge passage 74*a*, which includes the check valve 101. The check valve 101 opens and closes the discharge passage 74*a*. The discharge muffler 74, which is located upstream of the check valve 101, includes the relief valve 108. If the pressure in the compressor 22 is abnormally high when the check valve 101 closes the discharge passage 74*a*, the relief valve 108 releases the pressure out of the refrigerant circuit 21. Therefore, when the check valve 101 fails to function, the relief valve 108 prevents the pressure in the compressor 22 from being abnormally high.

When the compressor 22 is not operating, the check valve 101 closes the discharge passage 74*a* and the shutter 58 closes the suction passage 62. The check valve 101 and the shutter 58 prevent liquefied refrigerant from entering the compressor from the heat exchangers such as the condenser 26 and the evaporator 27 through the high and low pressure conduits 24, 25. If changes in the ambient temperature produce a difference between the temperature of the compressor 22 and the temperature of the heat exchangers, liquefied refrigerant does not enter the compressor 22. Thus, oil stored in the compressor 22 is prevented from being discharged from the compressor 22.

The compressor 22 is directly coupled to the engine E and is operated even if refrigeration is not necessary. However, even if the compressor 22 is operating at the minimum displacement, that is, if the inclination of the swash plate 52 is minimum, the check valve 101 closes the discharge passage 74*a* and the shutter 58 closes the suction passage 62. Thus, when the compressor is operating at the minimum displacement, liquefied refrigerant is prevented from entering the compressor 22 from the heat exchangers, and oil in the compressor 22 is prevented from being discharged to the high pressure passage 24. During the minimum displacement operation of the compressor 22, oil that has been discharged to the refrigerant circuit never returns to the compressor 21 and the lubrication in the compressor therefore tends to be insufficient. However, this embodiment prevents oil in the compressor 21 from being discharged to the high pressure conduit 24 with refrigerant gas thereby guaranteeing sufficient lubrication in the compressor 22 when the compressor 22 is operating at the minimum displacement.

The relief valve 108 is located in the front housing 42 of the compressor 22. Therefore, no relief valve needs to be provided on the piping of the refrigerant circuit 21. This simplifies the piping construction of the circuit 21 thereby allowing the circuit 21 to be compact.

The relief valve 108 corresponds to the discharge muffler 74, which is defined in the housing of the compressor 22. That is, the relief valve 108 is attached to the muffler 74, which has a relatively large volume. This construction increases the number of places where the relief valve 108 can be located. Thus, the direction of gas released from the valve 108 is easily aimed away from the engine E and other engine accessories. Also, the relief valve 108 easily avoids interference with other members of the compressor 22.

A refrigerant circuit according to a second embodiment of the present invention will now be described with reference to FIGS. 6 to 9. The differences from the first embodiment will mainly be discussed below, and like or the same reference numerals are given to those components that are like or the same as the corresponding components of the first embodiment.

Instead of the check valve 101 of the first embodiment, the refrigerant circuit 21 of this embodiment includes an electromagnetic valve 121 to open and close the high pressure conduit 24. The electromagnetic valve 121 and a relief valve 122 are not located in the compressor but are located in the high pressure conduit 24, or piping, connected to a compressor 127.

Figure 7:
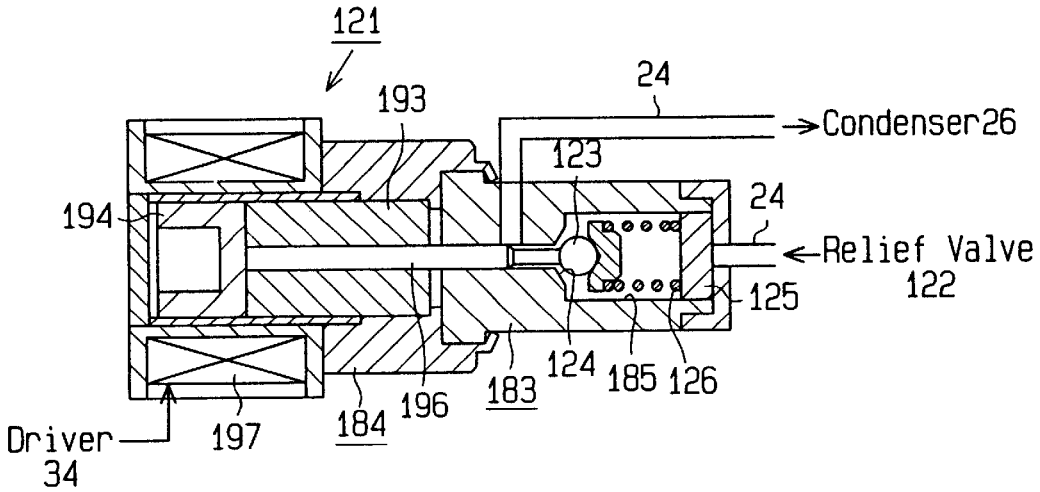
FIG. 7 is a cross-sectional view illustrating the electromagnetic valve of FIG. 6 when opened.
Figure 8:
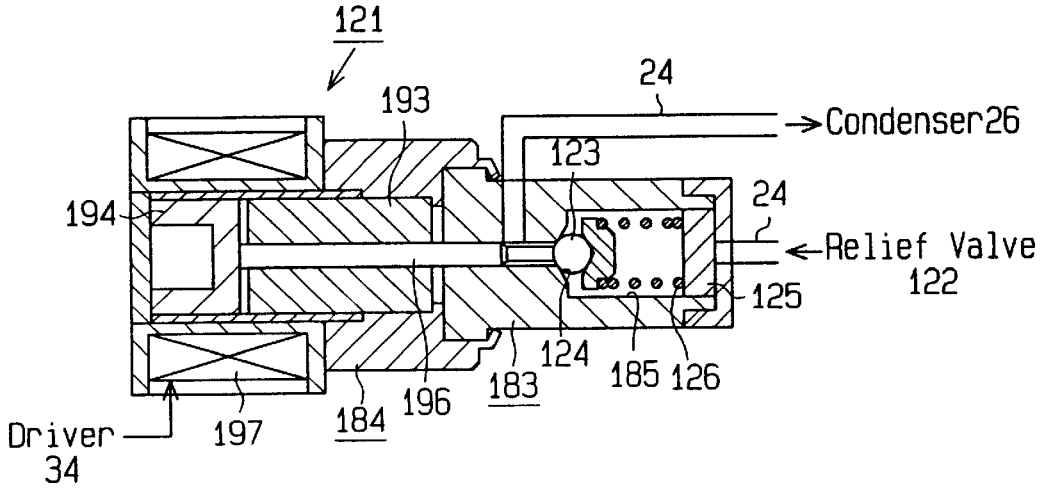
FIG. 8 is a cross-sectional view illustrating the electromagnetic valve of FIG. 6 when closed.

As shown in FIGS. 7 and 8, the electromagnetic valve 121 includes a valve housing 183 and a solenoid 184, which are secured to each other. A valve chamber 185 is defined in an end portion of the housing 183. The valve chamber 185 accommodates a valve body 123. The housing 183 also has a valve hole 124 that communicates with the valve chamber 185 and faces the valve body 123. The valve hole 124 is connected with the condenser 26 by the downstream portion of the high pressure conduit 24. The valve chamber 185 is connected with the upstream portion of the high pressure conduit 24 with a filter 125. A spring 126 extends between the valve body 123 and the filter 125 for urging the valve body 123 in a direction closing the valve hole 124. Like the solenoid 84 of the control valve 81 in the first embodiment, the solenoid 184 includes a fixed core 193, a plunger 194, a solenoid rod 196 and a coil 197.

Figure 6:
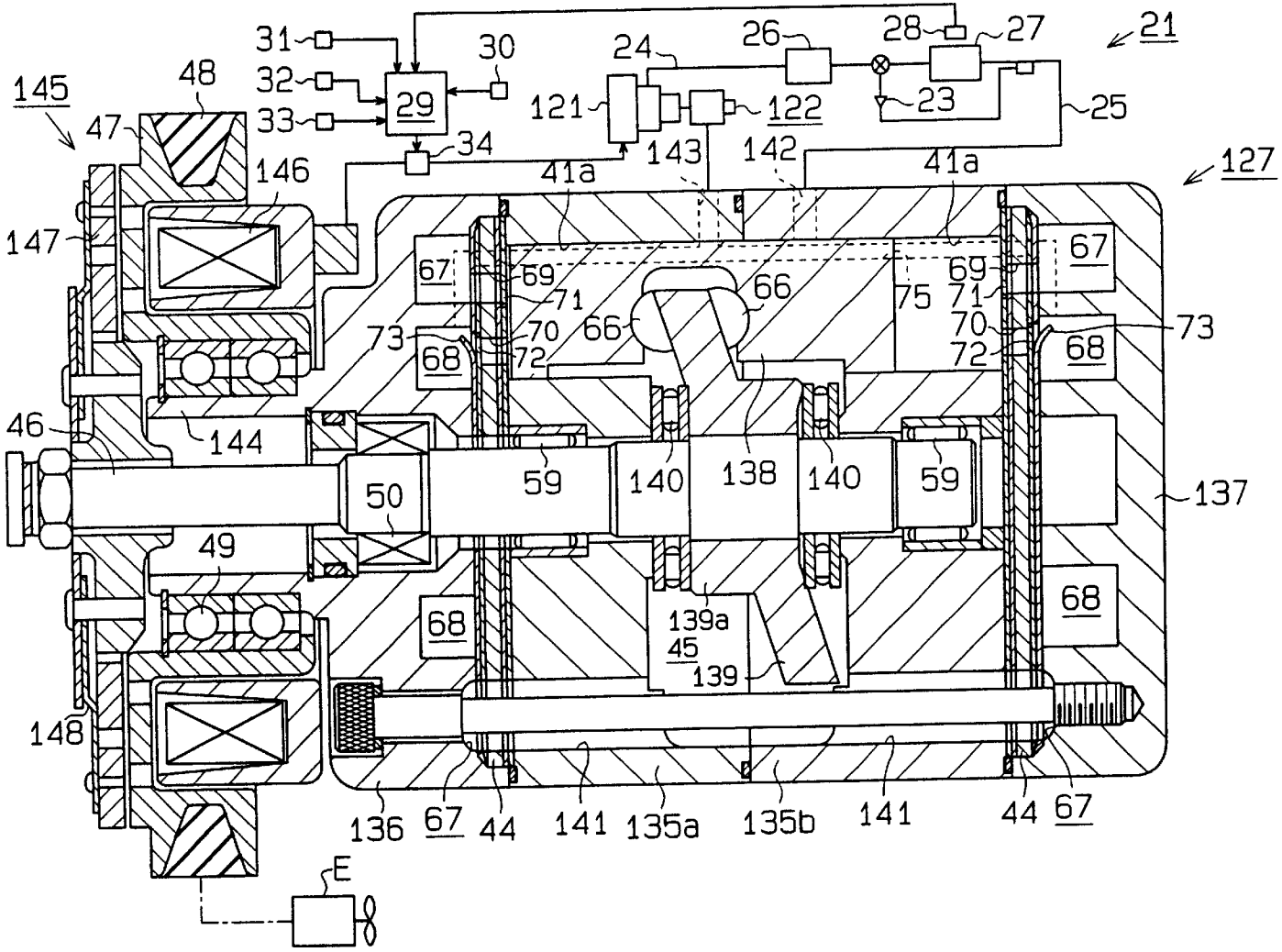
FIG. 6 is a block diagram showing a refrigerant circuit according to a second embodiment of the present invention including a cross-sectional view of a compressor in the circuit.
Figure 9A:
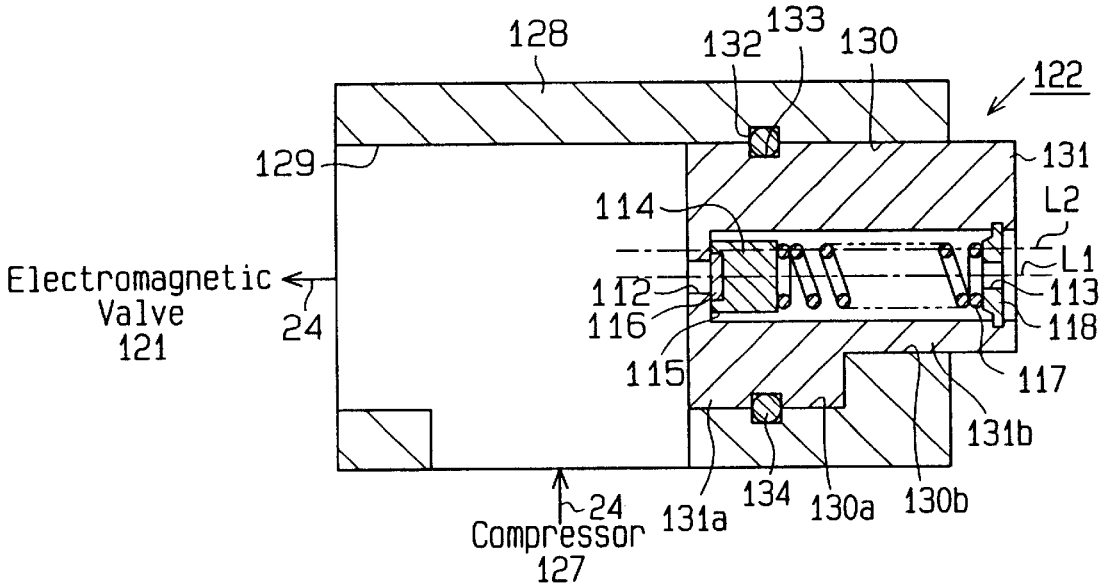
FIG. 9(*a*) is a cross-sectional view illustrating the relief valve of FIG. 6.
Figure 9B:
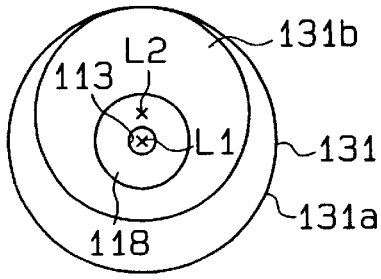

As shown in FIG. 6, the relief valve 122 is located in the high pressure conduit 24 between the electromagnetic valve 121 and an outlet 143 of the compressor 121. As shown in FIG. 9(*a*), a casing 128 of the relief valve 122 includes a substantially L-shaped passage 129 and an accommodating hole 130. The passage 129 is located midway in the high pressure conduit 24. The hole 130 includes a large diameter portion 130*a* and a small diameter portion 130*b*. The axis L2 of the small diameter portion 130*b* is displaced with respect to the axis L1 of the large diameter portion 130*a*.

As shown in FIGS. 9(*a*) and 9(*b*), a substantially cylindrical valve housing 131 is fitted to the hole 130. The valve housing 131 includes a large diameter portion 131*a*, which is fitted in the large diameter portion 130*a* of the hole 130, and a small diameter portion 131*b*, which is fitted in the small diameter portion 130*b* of the hole 130. Therefore, the axis L2 of the small diameter portion 131*b* is displaced from the axis L1 of the large diameter portion 131*a*. An annular groove 132 is formed in the large diameter portion 130*a* of the hole 130. The large diameter portion 131*a* of the valve housing 131 has an annular groove 133, which corresponds to the groove 132 in the hole 130. A sealing 134 is located in the grooves 132, 133.

A pressure receiving hole 112 is formed in the inner end of the valve housing 131 and communicates with the passage 129. A spring seat 118 is fitted to the outer end of the valve housing 131 and has a relief hole 113 in its center. A valve seat 115 is formed about the inner opening of the pressure receiving hole 112. The housing 110 accommodates a valve body 114. The valve body 114 faces the valve seat 115 and slides with respect to the housing 110. The valve body 114 has a contact portion 116 press fitted thereto. The contact portion 116 is made of an elastic material such as rubber and abuts against the valve seat 115. A spring 117 extends between the spring seat 118 and the valve body 114. The spring 117 urges the valve body 114 toward the valve seat 115. In the normal state, the contact portion 116 of the valve body 114 is pressed against the valve seat 115 and disconnects the pressure relief hole 113 from the pressure receiving hole 112.

The construction of the compressor 127 will now be described. As shown in FIG. 6, front and rear cylinder blocks 135*a*, 135*b* are secured to each other. A front housing 136 is secured to the front end face of the front cylinder block 135*a* with a valve plate 44 in between. A rear housing 137 is secured to the rear end face of the rear cylinder block 135*b* with a valve plate 44 in between. The front housing 136 and the rear housing 13 have annular suction chambers 67. Annular discharge chambers 68 are defined inside the suction chambers 67 in the front and rear housings 136, 137. Aligned pairs of cylinder bores 41*a* are defined in the front and rear cylinder blocks 135*a*, 135*b*. A double-headed piston 138 is reciprocally housed in each pair of cylinder bores 41*a*.

A crank chamber 45 is defined between the cylinder blocks 135*a*, 135*b*. The cylinder blocks 135*a*, 135*b* have aligned shaft holes. A drive shaft 46 is rotatably supported in the shaft holes by radial bearings 59. A swash plate 139 is fixed to the middle portion of the drive shaft 46. The swash plate 139 is also coupled to the central part of each piston 138 with a pair of shoes 66. The boss 139*a* of the swash plate 139 is supported between the cylinder blocks 135*a*, 135*b* with a pair of thrust bearings 140 in between.

The crank chamber 45 is connected with the suction chambers 67 by suction passages 141 formed in the cylinder blocks 135*a*, 135*b*. The crank chamber 45 is also connected with the low pressure conduit 25 of the refrigerant circuit 21 by an inlet 142 formed in the rear cylinder block 135*b*. The discharge chambers 68 are connected with the high pressure conduit 24 of the refrigerant circuit 21 by an outlet 143 formed in the front cylinder block 135*a* and a passage 75 formed in the cylinder blocks 135*a*, 135*b* and the housings 136, 137.

The front end portion of the drive shaft 46 protrudes from the front housing 136. A support sleeve 144 protrudes from the front housing 136. An electromagnetic clutch 145 is located about the sleeve 144 and the protruding portion of the drive shaft 46. The clutch 145 includes a pulley 47, which is rotatably supported on the sleeve 144 by an angular bearing 49. The pulley 47 is coupled to the vehicle engine E by a belt 48. The clutch 145 also includes a solenoid 146 and the clutch plate 147, which face each other with the pulley 47 in between. The clutch plate 147 is connected to the drive shaft 46 by a leaf spring 148. The spring 148 urges the clutch plate 147 away from the pulley 47. The solenoid 146 is excited by the driver 34 with electric current based on commands from the computer 29. When excited, the solenoid 146 causes the clutch plate 147 to be pressed against the pulley 47. When the solenoid 146 is de-excited, the spring 148 separates the clutch 147 from the pulley 47.

As shown in FIGS. 6 and 7, the computer 29 is connected to the solenoid 184 of the electromagnetic valve 121 via the driver 34. The computer 29 controls the magnitude of current supplied to the coil 197 of the valve 121 from the driver 34 simultaneously with control of the electromagnetic clutch 145. That is, the computer 29 commands the driver 34 to either stop or supply current to both the coil 197 of the valve 121 and to the solenoid 146 of the clutch 145 simultaneously.

The operation of the refrigerant circuit 21 having the compressor 127 will now be described.

When the air conditioner starting switch 32 is on, if the temperature detected by the compartment temperature sensor 31 is higher than a target temperature set by the temperature adjuster 30, the computer 29 commands the driver 34 to excite the solenoid 146 of the electromagnetic clutch 145. Accordingly, the solenoid 146 pulls the clutch plate 147 against the force of the spring 148 and causes the clutch 147 to be pressed against the pulley 47. This couples the pulley 47 with the drive shaft 46 thereby allowing the drive shaft 46 to be rotated by the engine E. The rotation of the shaft 46 is converted to linear reciprocation of each piston 138 in the associated pair of cylinder bores 41*a* by the swash plate 139 and the shoes 66. The reciprocation of the pistons 138 draws refrigerant gas from the low pressure conduit 25 of the refrigerant circuit 21 to the crank chamber 45 through inlet 142 of the compressor 127. The refrigerant gas in the crank chamber 45 is led to the suction chambers 67 by the suction passages 141. The gas is then drawn into the cylinder bores 41*a*. The gas in the cylinder bores 41*a* is compressed to a predetermined pressure and is discharged into the discharge chambers 68. The gas in the discharge chambers 68 is supplied to the high pressure conduit 24 of the refrigerant circuit 21 through the passage 75 and the outlet 143.

The computer 29 commands the driver 34 to excite the solenoid 184 of the electromagnetic valve 121 simultaneously with commanding the driver 34 to excite the solenoid 146 of the electromagnetic clutch 145. This generates magnetic attractive force between the fixed core 193 and the plunger 194 of the valve 121 thereby causing the valve body 123 to open the valve hole 124. Thus, the compressor 127 is connected with the condenser 26 by the high pressure conduit 24. Refrigerant gas compressed by the compressor 127 is therefore used to cool the passenger compartment.

As the cooling load is smaller than a cooling capacity of the compressor, the temperature of the evaporator 27 drops to a frost forming temperature. When the temperature sensor 28 detects a temperature that is equal to or lower than the frost forming temperature, the computer 29 commands the driver 34 to de-excite the solenoid 146 of the clutch 145. This allows the spring 148 to separate the clutch plate 147 from the pulley 47. The pulley 47 is disconnected from the drive shaft 46. That is, the drive shaft 46 is disconnected from the engine E. The rotation of the shaft 46, or the operation of the compressor 127, is thus stopped.

The computer commands the driver 34 to de-excite the solenoid 184 of the valve 121 simultaneously with the command of de-exciting the solenoid 146 of the clutch 145. When the solenoid 184 is de-excited, there is no magnetic attractive force between the fixed core 193 and the plunger 194. At this time, the spring 126 causes the valve body 123 to close the valve hole 124. Therefore, the high pressure conduit 24 of the refrigerant circuit 21 is closed. Liquefied refrigerant in the condenser 26 is thus prevented from flowing into the compressor 127, the refrigerant operation of the circuit 21 is stopped.

If the switch 32 is turned off or the engine E is stopped, electric current to the solenoid 146 of the clutch 145 and to the solenoid 184 of the valve 121 is also stopped. This stops the compressor 127 and causes the valve 121 to close the high pressure conduit 24.

This embodiment has the following advantages.

The high pressure conduit 24 of the refrigerant circuit 21 includes the electromagnetic valve 21, which opens and closes the conduit 24 with the compressor 127. Also, the relief valve 122 is located upstream of the valve 121 in the conduit 24. Therefore, if the pressure in the compressor 127 is abnormally high when the valve 121 closes the high pressure conduit 24, the relief valve 122 releases the pressure out of the refrigerant circuit 21. Therefore, if the valve 121 fails to function, the relief valve 122 prevents the pressure in the compressor 127 from being abnormally high.

When the compressor 127 is not operating, the electromagnetic valve 121 closes the high pressure conduit 24. Therefore, as in the first embodiment, liquefied refrigerant in the condenser 26 is prevented from flowing into the compressor 127 through the high pressure conduit 24. Thus, oil is prevented from being discharged from the compressor 127 with refrigerant.

The high pressure conduit 24 is opened and closed by the electromagnetic valve 121. The valve 121 operates based not on the pressure in the refrigerant circuit 21 but on commands from the computer 29. Therefore, the times at which the high pressure conduit 24 is opened and closed may be arbitrarily changed.

The electromagnetic clutch 145 is located between the drive shaft 46 of the compressor 127 and the engine E. The electromagnetic valve 121 is opened and closed simultaneously with engaging and disengaging of the clutch 145. In other words, the high pressure conduit 24 is opened and closed simultaneously with starting and stopping of the operation of the compressor 127. Therefore, when the compressor 127 is stopped, the conduit 24 is securely closed and liquefied refrigerant is positively prevented from flowing into the compressor 127 from the conduit 24.

The present invention may be alternatively embodied in the following forms:

In the second embodiment, a discharge muffler may be formed in the top portion of the cylinder blocks 135*a*, 135*b* and a relief valve may be provided in the muffler as in the first embodiment. Further, like the check valve 101 in the first embodiment, the electromagnetic valve 121 may be located at the outlet of the muffler. In this manner, a relief valve and an electromagnetic valve may be directly formed in the compressor 127.

In the first embodiment, a clutch such as the electromagnetic clutch 145 of the second embodiment may be located between the pulley 47 and the drive shaft 46.

The present invention may be embodied in compressors other than the compressors of FIGS. 1 and 6. For example, the present invention may be embodied in single-headed piston type fixed displacement compressor, double-headed piston type variable displacement compressor, wave cam plate type compressors, wobble plate type compressors, scroll type compressors and vane-type compressors.

Therefore, the present examples and embodiments are to be considered as illustrative and not restrictive and the invention is not to be limited to the details given herein, but may be modified within the scope and equivalence of the appended claims.

What is claimed is:

1. A refrigerant circuit that includes a compressor and an expansion valve, wherein a high pressure passage connects a discharge chamber in the compressor to the expansion valve to send high pressure refrigerant from the compressor to the expansion valve, and wherein a low pressure passage connects the expansion valve to a suction chamber in the compressor to send low pressure refrigerant from the expansion valve to the compressor, the refrigerant circuit comprising:

a valve device located in the high pressure passage to selectively connect and disconnect the high pressure passage with the discharge chamber; and a relief valve is located in the high pressure passage to release excess pressure from the discharge chamber to the outside of the refrigerant circuit, wherein the relief valve is located upstream of the valve device.

2. The refrigerant circuit according to claim 1, wherein the valve device disconnects the high pressure passage from the discharge chamber when the compressor is stopped.

3. The refrigerant circuit according to claim 2, wherein the valve device is operated in accordance with the difference between the pressure upstream of the valve device and the pressure downstream of the valve device.

4. The refrigerant circuit according to claim 3, wherein the valve device includes a check valve for allowing only discharge of refrigerant from the discharge chamber to the high pressure passage.

5. The refrigerant circuit according to claim 2, wherein the valve device includes an electromagnetic valve.

6. The refrigerant circuit according to claim 5, wherein an external driving source is connected to the compressor to operate the compressor, wherein a clutch is located between the external driving source and the compressor to selectively connect and disconnect the compressor with the external driving source, and wherein the electromagnetic valve is operated simultaneously with the operation of the clutch.

7. The refrigerant circuit according to claim 1, wherein the relief valve is mounted to the compressor.

8. The refrigerant circuit according to claim 7, wherein the compressor includes a discharge muffler for suppressing pulsation of refrigerant discharged from the discharge chamber, wherein the relief valve is attached to the discharge muffler to release abnormally high pressure from the discharge muffler.

9. The refrigerant circuit according to claim 8, wherein the high pressure passage includes an external high pressure passage extending from the compressor and an internal high pressure passage located in the compressor, wherein the internal high pressure passage connects the discharge chamber to the external high pressure passage, wherein the internal high pressure passage includes the discharge muffler and a discharge passage for connecting the discharge muffler to the external high pressure passage, and wherein the valve device is located in the discharge passage.

10. The refrigerant circuit according to claim 1 further comprising a shutter located in the low pressure passage to selectively connect and disconnect the low pressure passage with the suction chamber, wherein the shutter disconnects the low pressure passage from the suction chamber when the compressor is stopped.

11. A compressor incorporated in a refrigerant circuit, wherein the compressor compresses refrigerant gas supplied from an external low pressure passage of the refrigerant circuit and discharges the compressed refrigerant gas from a discharge chamber to an external high pressure passage of the refrigerant circuit, wherein the compressor includes an internal passage for connecting the discharge chamber to the external high pressure passage, the compressor comprising:

a valve device located in the internal passage to selectively connect and disconnect the external high pressure passage with the discharge chamber; and a relief valve located between the discharge chamber and the valve device to release excess pressure from the discharge chamber to the outside of the refrigerant circuit.

12. The compressor according to claim 11, wherein the valve device disconnects the external high pressure passage from the discharge chamber when the compressor is stopped.

13. The compressor according to claim 12, wherein the valve device includes a check valve that is operated in accordance with the difference between the pressure upstream of the check valve and the pressure downstream of the check valve to allow only discharge of refrigerant gas from the discharge chamber to the external high pressure passage.

14. The compressor according to claim 12, wherein the internal passage includes a discharge muffler for suppressing pulsation of refrigerant gas discharged from the discharge chamber, wherein the relief valve is attached to the discharge muffler to release abnormally high pressure from the discharge muffler.

15. The compressor according to claim 14, wherein the internal passage includes a discharge passage for connecting the discharge muffler to the external high pressure passage, wherein the valve device is located in the discharge passage.

16. The compressor according to claim 12 further comprising:

a housing having a crank chamber and a cylinder bore;

a drive shaft rotatably supported by the housing;

a drive plate located in the crank chamber and tiltably mounted on the drive shaft;

a piston located in the cylinder bore and operably connected to the drive plate, wherein the drive plate converts rotation of the drive shaft to reciprocation of the piston, and wherein the piston compresses refrigerant gas supplied from the external low pressure passage to the cylinder bore and discharges the compressed refrigerant gad from the cylinder bore to the discharge chamber;

wherein the drive plate is tiltable between a minimum inclination angle position and a maximum inclination angle position according to the difference between the pressure in the crank chamber and the pressure in the cylinder bore, wherein the piston moves by a stroke based on the inclination of the drive plate to change the displacement of the compressor; and wherein the valve device disconnects the external high pressure passage from the discharge chamber when the drive plate is moved to the minimum inclination angle position to minimize the displacement of the compressor, and wherein the valve device connects the external high pressure passage to the discharge chamber when the drive plate is moved to an inclination angle position having an inclination that is greater than that of the minimum inclination angle position.

17. The compressor according to claim 16 further comprising a shutter for selectively connecting and disconnecting the external low pressure passage with the compressor, wherein the shutter disconnects the external low pressure passage from the compressor when the drive plate is moved to the minimum inclination angle position.

18. A compressor incorporated in a refrigerant circuit, the compressor including a drive plate mounted on a drive shaft in a crank chamber and a piston located in a cylinder bore, wherein the drive plate is operably connected to the piston to convert rotation of the drive shaft to reciprocation of the piston, and wherein the drive plate is tiltable between a minimum inclination angle position and a maximum inclination angle position according to the difference between the pressure in the crank chamber and the pressure in the cylinder bore, wherein the piston moves by a stroke based on the inclination of the drive plate to change the displacement of the compressor, and wherein the piston compresses refrigerant gas supplied from an external low pressure passage of the refrigerant circuit to the cylinder bore through a suction chamber and discharges the compressed refrigerant gas from the cylinder bore to an external high pressure passage of the refrigerant circuit through a discharge chamber, the compressor comprising:

a discharge muffler located between the discharge chamber and the external high pressure passage to suppress pulsation of refrigerant gas discharged from the discharge chamber;

a check valve located between the discharge muffler and the external high pressure passage to selectively connect and disconnect the external high pressure passage with the discharge muffler, wherein the check valve is operated in accordance with the difference between the pressure in the discharge muffler and the pressure in the external high pressure passage to allow only discharge of refrigerant gas from the discharge muffler to the external high pressure passage; and a relief valve attached to the discharge muffler to release abnormally high pressure from the discharge muffler to the outside of the refrigerant circuit.

19. The compressor according to claim 18 further comprising a shutter for selectively connecting and disconnecting the external low pressure passage with the suction chamber, wherein the shutter disconnects the external low pressure passage from the suction chamber when the drive plate is moved to the minimum inclination angle position.

20. A refrigerant circuit that includes a compressor and an expansion valve, wherein a high pressure passage connects a discharge chamber in the compressor to the expansion valve to send high pressure refrigerant from the compressor to the expansion valve, and wherein a low pressure passage connects the expansion valve to a suction chamber in the compressor to send low pressure refrigerant from the expansion valve to the compressor, the refrigerant circuit comprising:

a valve device located in the high pressure passage to selectively connect and disconnect the high pressure passage with the discharge chamber; and a relief valve located in the high pressure passage, wherein the relief valve is operable to release excess pressure from the discharge chamber to the outside of the refrigerant circuit when said valve device disconnects the high pressure passage from the discharge chamber.

21. The refrigerant circuit according to claim 1 further comprising a condenser located in the high pressure passage between the compressor and the expansion valve, wherein the valve device and the relief valve are located between the discharge chamber and the condenser.

22. A refrigerant circuit that includes a compressor and an expansion valve, wherein a high pressure passage connects a discharge chamber in the compressor to the expansion valve to send high pressure refrigerant from the compressor to the expansion valve, and wherein a low pressure passage connects the expansion valve to a suction chamber in the compressor to send low pressure refrigerant from the expansion valve to the compressor, the refrigerant circuit comprising:

a valve device located in the high pressure passage to selectively connect and disconnect the high pressure passage with the discharge chamber;

a relief valve is located in the high pressure passage, wherein the relief valve is located upstream of the valve device; and a control valve disposed in the compressor for regulating the suction pressure in response to thermal information received by a controller.

* * * * *

UNITED STATES PATENT AND TRADEMARK OFFICE

CERTIFICATE OF CORRECTION

PATENT NO. : 6,227,812 B1
DATED : May 8, 2001
INVENTOR(S) : Kawaguchi et al.

It is certified that error appears in the above-identified patent and that said Letters Patent is hereby corrected as shown below:

Column 1,
Line 6, please change “conditioners” to -- conditioners. --;

Column 5,
Line 23, please change “24.” to -- 24 --;

Column 8,
Line 35, please change “temperature.” to -- temperature --;

Column 17,
Line 24, please change “gad” to -- gas --;

Signed and Sealed this

Twenty-third Day of July, 2002

*Attest:*

*Attesting Officer*

JAMES E. ROGAN
*Director of the United States Patent and Trademark Office*